US005417592A

United States Patent [19]

West

[11] Patent Number: 5,417,592

[45] Date of Patent: May 23, 1995

[54] CABLE-FIXED TAKEOUT

[75] Inventor: Gregory W. West, Houston, Tex.

[73] Assignee: Houston Geophysical Products, Inc., Houston, Tex.

[21] Appl. No.: 243,216

[22] Filed: May 16, 1994

[51] Int. Cl.[6] ..... H01R 9/03

[52] U.S. Cl. ..... 439/624; 439/278; 439/505

[58] Field of Search ..... 439/190–206, 439/271, 278, 283, 502, 505

[56] References Cited

U.S. PATENT DOCUMENTS 2,654,077 9/1953 McLoad ..... 439/624
4,445,741 1/1984 Annoot ..... 439/624
4,917,632 4/1990 Smith ..... 439/624
5,199,893 4/1993 Fussell ..... 439/624

*Primary Examiner*—David Pirlot
*Attorney, Agent, or Firm*—Bush, Moseley, Riddle & Jackson

[57] ABSTRACT

A pigtail-type takeout on a seismic cable including a molded elastomer Y-body, a pigtail and a multi-contact connector for connecting the end of a geophone string to the cable. The connector body includes a longitudinally split inner tubular portion that is fitted around the cable, and tie wraps are used to encircle and hold the tubular portion tightly around the cable to firmly mount the connector body thereon.

5 Claims, 1 Drawing Sheet

CABLE-FIXED TAKEOUT

FIELD OF THE INVENTION

This invention relates generally to takeout structures that are used to electrically connect a geophone string to a seismic cable, and particularly to a pigtail-type takeout where the plug assembly is mounted to the cable in a secure and reliable manner.

BACKGROUND OF THE INVENTION

To conduct a land seismic survey, a cable having a plurality of pairs of electrical conductors is layed out along a survey line and connected at one end to a recording device. At spaced locations along the cable, usually called stations, a "takeout" is provided that enables the leader wire of a string of geophones to be electrically connected to one of the pairs of conductors inside the cable. Each pair of conductors and the phones connected thereto form a data channel so that acoustic waves that are reflected upward from subsurface boundaries between rock strata will be recorded on that channel of the recorder which is hooked up to that particular pair.

Takeouts have been built in numerous forms. One structure that is fairly popular includes a molded elastomer Y-block on the cable having a pigtail that leads to a molded connector assembly. The assembly has a pair of electrical contacts that mate with the contacts of a companion connector on the end of the geophone leader wire. One reason for the popularity of this type takeout is that if the connector assembly becomes damaged in some way, the pigtail can be cut to a shorter length and a new connector assembly spliced onto it. However since the pigtail and connector assembly provide a flexible appendage on the side of the cable, a common practice in the field is to wrap a large amount of electrical tape around the pigtail, the connector assembly and the cable to secure the components alongside the cable. However this procedure is time consuming and troublesome, and with time the tape will begin to peel loose and come off, which requires further time and attention.

The general object of the present invention is to provide a new and improved takeout of the type described that is constructed and arranged to obviate the foregoing problems.

Another object of the present invention is to provide a new and improved takeout structure of the type described where a pigtail mounted connector assembly is firmly mounted in a unique manner on the cable.

SUMMARY OF THE INVENTION

These and other objects are attained in accordance with the concepts of the present invention through the provision of a takeout including an elastomer Y-block molded onto a seismic cable having a plurality of pairs of insulated conductors therein, a pigtail integrally formed with the block and extending generally parallel to the axis of the cable, and a connector assembly on the outer end of the pigtail having a pair of contacts that are connected to a pair of the insulated conductors in the cable by leads that extend through the block and the pigtail. The connector assembly has an inner portion formed with a longitudinal cylindrical recess that has an internal diameter that is slightly less than the outer diameter of the cable, and which is opened to the outside by a longitudinal slit which enables the inner portion to be temporarily opened to allow the adjacent portion of the cable to be positioned in the recess. On a more apertures that extend transversely through a wall of the assembly between the inner portion and the connector body allow means such as plastic tie wraps to be used to strap or cinch the inner portion firmly around the cable section with the axis of the connector body substantially parallel to longitudinal axis of the cable.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
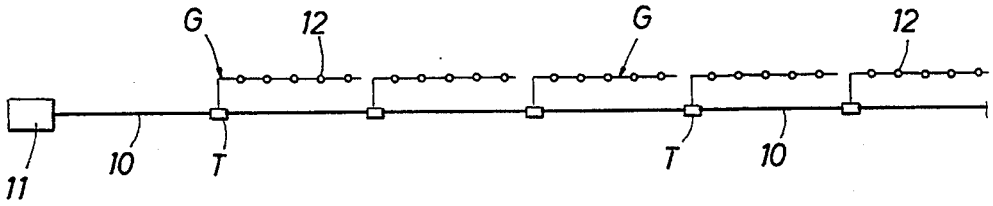
FIG. 1 is a schematic view of a seismic exploration operation.

Referring initially to FIG. 1, a typical land seismic survey is made using a long main cable 10 which has a large number of individual pairs of insulated conductors inside a protective outer sheath. Each pair of the conductors is connected to a channel of a data recorder 11 which is located at the inner end of the cable 10. Takeouts T are molded onto the cable at longitudinally spaced stations, and each takeout includes a connector having pin and socket contacts which mate with the contacts of a companion connector on the end of a geophone string G which is layed out alongside the cable 10. Each geophone string G has a number of geophones 12 that are fixed to the ground and generate electrical output signals in response to acoustic wave reflections. The signals from each string G are fed by the cable conductor pair to which the string is connected to the recorder 11 which makes a seismic record thereof. The record or traces made by the recorder 11 is used to make a sectional map of the underground rock structures in the usual manner.

Figure 2:
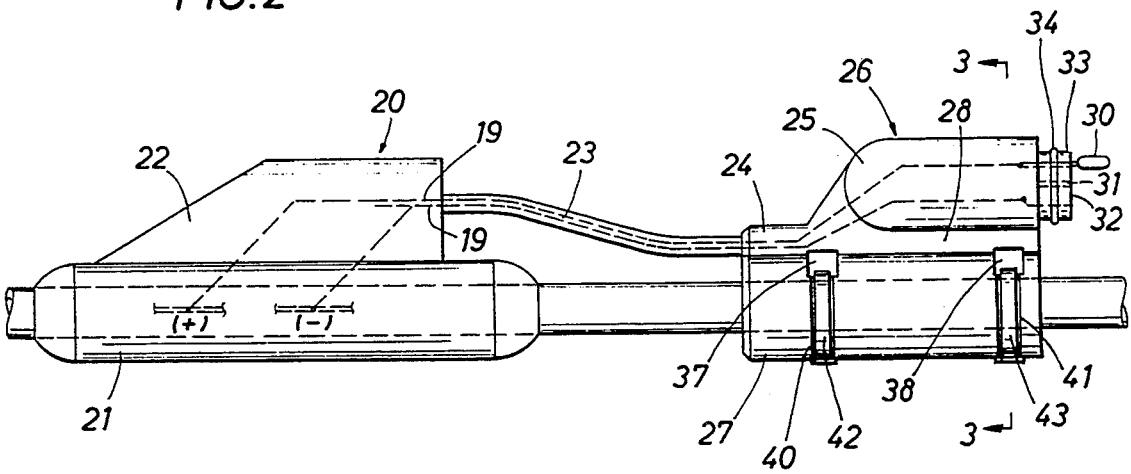
FIG. 2 is a side section, with some portions in elevation, of a takeout assembly in accordance with the invention.
Figure 3:
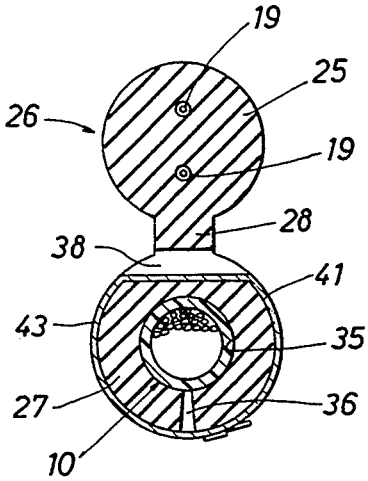
FIG. 3 is a cross-section on line 3—3 of FIG. 2.

The structure of each of the takeouts T, which is made in accordance with the present invention, is show in FIGS. 2 and 3. A Y-block indicated generally at 20 that is made of a curable elastomer is molded onto the cable 10 at each station, and includes an inner portion 21 that encircles the cable and an outer portion 22 to the side of the cable. A pair of leads 19 is positioned within the outer portion 22 and their respective inner ends are electrically connected to the stripped regions of a pair of the conductors in the cable 10. The outer end portions of the leads 19 extend generally centrally through a tubular elastomer pigtail 23 having its inner end formed integrally with the outer portion 22 of the block 20 and its outer end formed integrally with a boss 24 on the rear of the outer portion 25 of a connector assembly 26. The assembly 26 also is molded of a suitable elastomer and includes an inner tubular portion 27 that is joined to the outer portion 25 by a web 28 having reduced thickness.

The pair of leads 19 extend through the outer portion 25 and have their respective outer ends electrically connected to a projecting contact pin 30 and a metal contact sleeve 31 located in a socket 32. Of course other contact elements could be used. The pin and sleeve 30, 31 are mounted on a reduced diameter tubular hub 33 which is surrounded by an outwardly projecting seal 34. The electrical connector (not shown) on the end of a geophone string G has companion contact components which mate with the pin 31 and the sleeve 32, as well as an outer skirt that fits over the hub 32 and is engaged by the seal 34 to provide a moisture-proof connection.

As shown in FIG. 3, the inner portion 27 of the connector 26 is generally tubular in form and has an internal cylindrical recess 35 having about the same, or a slightly smaller, diameter as the outer diameter of the main cable 10. The recess 35 is opened to the outside by a longitudinal radial slit 36 so that the sides of the inner portion 27 can be temporarily flexed outward and opened up to allow it to be positioned around the adjacent section of the cable 10. Referring again to FIG. 2, longitudinally spaced transverse apertures 37, 38 are formed at the junction of the web 28 and the portion 27, and shallow circumferential recesses 40, 41 are formed around the outer periphery of the inner portion 27 in radial alignment with the respective apertures 37, 38. To mount the connector assembly 26 firmly on the cable 10, plastic tie wraps 42, 43 are extended through the apertures 37, 38 and then are buckled and cinched tightly around the portion 27 while laying partially in the recesses 40, 41.

OPERATION

In use and operation, the seismic cable 10 has a takeout T made at a selected point or station thereon by making a slit in the jacket, removing the insulation from short sections of a pair of the conductors therein, and soldering the inner ends of the leads to such bared sections. A suitably shaped mold and curable elastomer are used to form the Y-body 20, the pigtail 23 and the connector body 32 with the conductor wires 19 extending therethrough and to the electrical contacts 31, 32. The inner portion 27 of the connector 26 is formed as shown in FIG. 3 with the cylindrical recess 35 and the slot 36 extending throughout the length of the portion 27.

The connector 26 is mounted on the cable 10 by spreading apart the sides of the inner portion 27 so that the cable 10 can be positioned in the recess 35 via the slot 36. The inner portions then are allowed to resile toward each other so that the slot 36 has only a narrow final width. Then the plastic tie wraps 42, 43 are inserted through the apertures 37, 38 and tightened around the portion 27 and the cable 10 to firmly mount the connector assembly 26 on the cable. Any excess length of a tie wrap can be cut off. The invention eliminates the use of electrical tape in mounting a connector body on the cable, with attendant advantages and features set forth above.

It now will be recognized that a new and improved pigtail connector mounting structure for a seismic cable has been disclosed. Since certain changes or modifications may be made in the disclosed embodiments without departing from the inventive concepts involved, it is the aim of the appended claims to cover all such changes and modifications falling within the true spirit and scope of the present invention.

What is claimed is:

1. A takeout structure for use in electrically connecting a geophone string to a seismic cable having a plurality of pairs of electrical conductors therein, comprising: first elastomer body means molded on said cable and having a pigtail, said body means and pigtail having a pair of electrical leads extending therethrough and connected to one of said pairs of conductors in said cable, said pigtail having an outer end; connector means including a second elastomer body on said outer end of said pigtail and having electrical contact means connected to respective ones of said leads; longitudinally split elastomer mounting means joined to said second body and adapted to be fitted around said cable in order to mount said connector means on said cable in longitudinally spaced relationship to said first body; and means encircling said mounting means and said cable for securing said connector means to said cable.

2. The structure of claim 1 wherein said mounting means has a generally tubular form with an inner diameter that is slightly less than the outer diameter of said cable.

3. The structure of claim 2 wherein said longitudinal split extends through the wall of said mounting means along the side thereof which is opposite said second body.

4. The structure of claim 3 wherein said securing means includes transverse aperture means between said second body and mounting means; and means extending through said aperture means and around said mounting means for cinching said mounting means tightly around said cable.

5. The structure of claim 4 wherein said aperture means includes axially spaced apertures; said securing means including tie wraps extending through each of said apertures; and groove means extending circumferentially around said mounting means in transverse alignment with said aperture means for guiding said tie wraps.

* * * * *